US008590140B2

(12) United States Patent
Wei et al.

(10) Patent No.: US 8,590,140 B2
(45) Date of Patent: Nov. 26, 2013

(54) METHOD FOR MANUFACTURING ALLOY RESISTOR

(75) Inventors: Shih-Long Wei, Hsinchu County (TW); Shen-Li Hsiao, Hsinchu County (TW); Chien-Min Shao, Hsinchu County (TW); Chien-Hung Ho, Hsinchu County (TW)

(73) Assignee: Viking Tech Corporation, Hsinchu County (TW)

( * ) Notice: Subject to any disclaimer, the term of this patent is extended or adjusted under 35 U.S.C. 154(b) by 316 days.

(21) Appl. No.: 12/873,827

(22) Filed: Sep. 1, 2010

(65) Prior Publication Data

US 2012/0000066 A1 Jan. 5, 2012

(30) Foreign Application Priority Data

Jul. 2, 2010 (TW) ..... 99121785 A

(51) Int. Cl.
*H01C 17/00* (2006.01)

(52) U.S. Cl.
USPC ..... 29/610.1; 29/412; 29/621; 29/879; 29/885

(58) Field of Classification Search
USPC ..... 29/611, 412, 413, 610.1, 612, 620, 621, 29/623, 879, 885; 338/204, 307, 309, 322, 338/328
See application file for complete search history.

(56) References Cited

U.S. PATENT DOCUMENTS 4,792,781 A * 12/1988 Takahashi et al. ..... 338/307
7,667,568 B2 * 2/2010 Tanimura et al. ..... 338/309
8,018,318 B2 * 9/2011 Wang et al. ..... 338/204

* cited by examiner

*Primary Examiner* — Thiem Phan
(74) *Attorney, Agent, or Firm* — Shoemaker and Mattare

(57) ABSTRACT

A fabrication method of an alloy resistor includes: providing an alloy sheet having a plurality of openings spacing apart from each other and going through the alloy sheet and a plurality of alloy resistor units located between any two adjacent openings, wherein each of the alloy resistor units has an insulating cover area and a plurality of electrode ends on both sides of the insulating cover area; forming an insulating layer on a surface of the insulating cover area of the alloy resistor units by an electrodeposition coating process; cutting the alloy along a connecting portion, so as to obtain separated alloy resistor units; and forming a conductive adhesion material on the electrode ends of the alloy resistor units. An alloy resistor having an insulating layer with a smooth surface can be obtained by performing an electrodeposition coating process.

8 Claims, 4 Drawing Sheets

METHOD FOR MANUFACTURING ALLOY RESISTOR

FIELD OF THE INVENTION

The present invention relates to a method for manufacturing passive components, and more particularly, to a method for manufacturing an alloy resistor.

BACKGROUND OF THE INVENTION

A conventional resistor is, for example, a ceramic resistor having axial leads on both sides, thereafter, different types of surface mount chip resistors are fabricated by thick film printing process, which mainly perform a series of processes including a printing process, a laser-modification process, a process for forming copper electrode ends, and an electroplating process in order to form a desired resistor on a selected ceramic substrate.

In addition, an alloy transistor is also used widely. However, as shown in FIG. 3, when the alloy transistor is made by a traditional thick film printing process, the printing process has directional limitation. If the printing direction is not paid more attention during the printing process, it is easily to fail to form a ring-shaped insulating layer 36 which can cover an insulating cover area 323 of an alloy resistor unit 32 during the printing process of the insulating layer 36. Therefore, the product yield decreases.

To solve above problem, a method for forming an insulating layer by spray coating process is provided. However, when the surface of the insulating layer which is formed by spray coating process is not uniform or the workpieces has a dead angle, the subsequent surface adhesion process will be affected. In addition, in spray coating process, since the spray coating material has a lower flash point, the temperature control should be paid much attention to its surroundings for avoiding a process risk. Also, the dryness of spray particles and the dust control are key factors to influence the product quality during the spray process. Furthermore, there is a method for forming the insulating layer such as epoxy resin by a press molding. However, if various appearances of alloy resistors are required, an additional mold will be necessary to fabricate, and in addition, the remained excess epoxy resin in mold channels often adhered to workpieces which has to be removed. Thus, the increased working hours for removing the excess epoxy resin and the additional expenses of fixtures and equipments may lead to inconvenient processes and reduce the cost advantage.

Therefore, it is a necessary to develop an easy and efficient manufacturing method capable of obtaining an alloy resistor having an insulating layer with a smooth surface under the existent process.

SUMMARY OF THE INVENTION

In light of the drawbacks of the aforementioned prior art, the present invention provides an alloy resistor having an insulating layer with a smooth surface.

According to the present invention, a fabrication method for forming an alloy resistor is provided. The fabrication method comprises the steps of: providing an alloy sheet having a plurality of openings spacing apart from each other and going through the alloy sheet and a plurality of alloy resistor units located between any two adjacent openings, wherein each of the alloy resistor units has an insulating cover area and a plurality of electrode ends on both sides of the insulating cover area; forming an insulating layer on a surface of the insulating cover area of the alloy resistor units by an electrodepositing process; cutting the alloy sheet to obtain separated alloy resistor units; and forming a conductive adhesion material on the electrode ends of the alloy resistor units.

In the aforesaid method, the openings are formed by stamping, and the fabrication method for forming the insulating layer includes forming a deposition resistant layer on a surface of the alloy sheet for exposing the insulating cover area of the alloy resistor units; forming the insulating layer by an electrodeposition coating process; and removing the deposition resistant layer.

In addition, the fabrication method for forming the alloy resistor may further comprise forming a conductive layer such as copper on the electrode ends after covering the insulating layer. Alternatively, the conductive layer can be formed by barrel-plating. Furthermore, the conductive adhesion material can be made of one or more selected from the group consisting of nickel and stannum.

In the present invention, a plurality of openings spacing apart from each other and going through the alloy sheet are formed in the alloy sheet, and a ring-shaped insulating layer is plated on the alloy sheet with a side surface of the openings by an electrodepositing process, wherein the insulating layer is formed by a plating material with positive or negative ions, as a result, an insulating layer having a smooth surface can be obtained.

DETAILED DESCRIPTION OF PREFERRED EMBODIMENTS

Hereunder, embodiments of the present invention will be described in full detail with reference to the accompanying drawings.

The following specific embodiment is provided to illustrate the present invention. Others skilled in the art can readily gain an insight into other advantages and features of the present invention based on the contents disclosed in this specification. The present invention can also be performed or applied in accordance with other different embodiments. Various modifications and changes based on different viewpoints and applications yet still within the scope of the present invention can be made in the details of the specification.

FIG. 1A to 1E are cross-sectional views illustrating a fabrication method for forming an alloy resistor according to a first embodiment of the present invention.

Figure 1A:
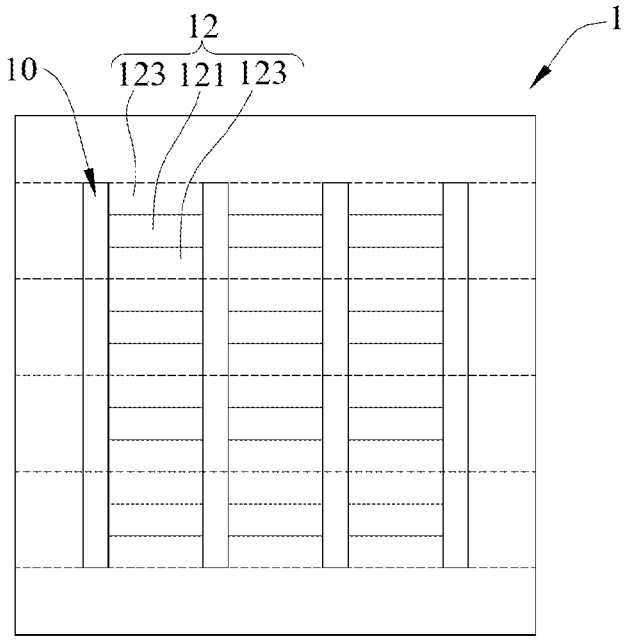
FIGS. 1A to 1E are cross-sectional views illustrating a fabrication method for forming an alloy resistor according to a first embodiment of the present invention.

As shown in FIG. 1A, an alloy sheet 1 is provided and it can be a flat sheet or a strip material, and may be made of a material selected from the group consisting of nickel, chromium, magnesium, aluminum, and copper, or made of an alloy composed of any metals selected from the aforesaid group. The alloy sheet 1 includes a plurality of openings 10 spacing apart from each other and going through the alloy sheet 1; a plurality of alloy resistor units 12 located between any two adjacent openings 10, wherein each alloy resistor units 12 has an insulating cover area 121 and electrode ends 123 located on both sides of the insulating cover area 121. The openings 10 of the alloy sheet 1 are often formed by a stamping process.

Figure 1B:
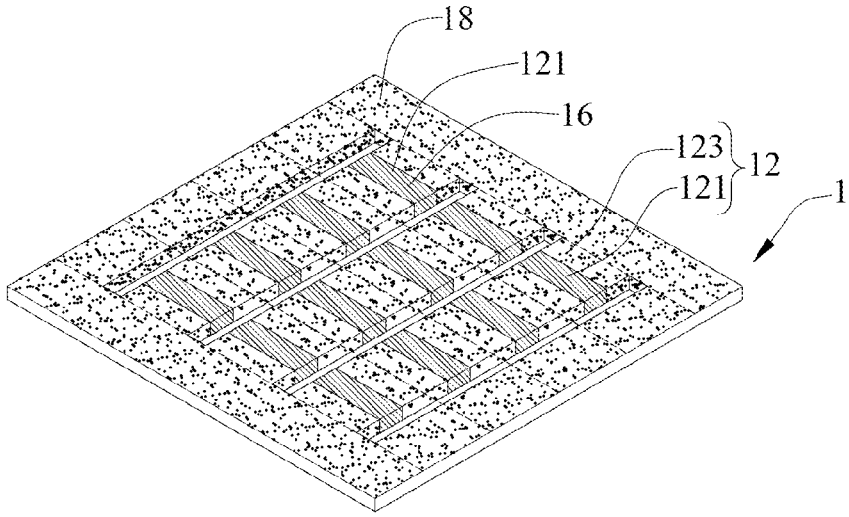
Figure 1C:
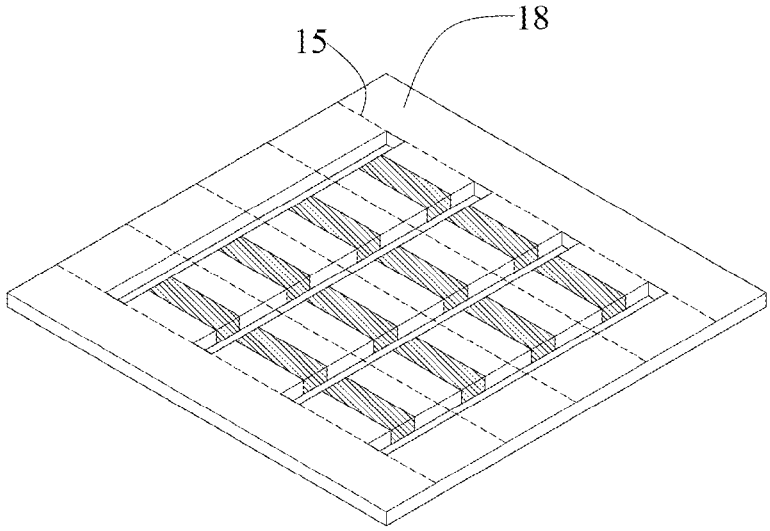
Figure 1D:
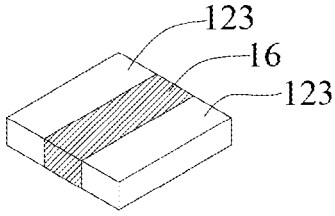

As shown in FIG. 1B, an insulating layer 16 is formed on the surface of the insulating cover area 121 of the alloy resistor units 12 by an electrodeposition coating process. Specifically, the formation of the insulating layer 16 comprises the following steps: forming a deposition resistant layer 18 on a surface of the alloy sheet 1, and the insulating cover area 121 of the alloy resistor units 12 is exposed; placing the alloy sheet 1 into a tank (not shown in the drawing) which contains positive or negative ions and making the alloy sheet 1 electrical conductive, and then a plating material with positive or negative ions is plated to the surface of the insulating cover area 121, so as to form the insulating layer 16; and removing the deposition resistant layer 18, as shown in FIG. 1C. The electrodeposition coating process is carried out by forming the plating material with positive or negative ions on a surface which is to be plated, such that there is no the drawback of directional limitation of printing process and the non-uniform problem of the film of spray coating process. In addition, according to various requirements, the pattern of the deposition resistant layer 18 can be changed, such as exposing the both electrode ends 123 of the alloy resistor units 12. Thus, the coating material can cover portions of the electrode ends 123. That is, the insulating layer 16 can extend to portions of electrode ends 123 from the insulating cover area 121.

Again referring to FIGS. 1C and 1D, the alloy sheet 1 is cut along a separating line 15, so as to form separated alloy resistor units 12.

Figure 1E:
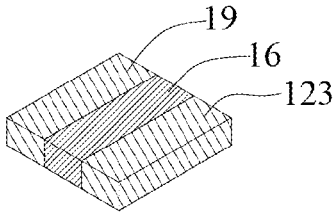

Finally, a conductive adhesion material 19 is formed on the electrode ends 123 of the alloy resistor units 12, and thus an alloy resistor can be obtained according to the present invention. The conductive adhesion material 19 can be made of one or more selected form the group consisting of nickel and stannum. Furthermore, the conductive adhesion material 19 is completely covering the surface of the electrode ends 123, as shown in FIG. 1E. However, the conductive adhesion material 19 also can be formed on a single side of the electrode ends 123 in order to connect the alloy resistor to other electrical device such as a circuit board.

In addition, the formation of the alloy resistor further can include forming a conductive layer such as copper on the electrode ends after covering the insulating layer.

However, the formation of the conductive layer on the electrode ends may also be formed by barrel plating after separating the alloy resistor units.

Second Exemplary Embodiment

Figure 2A:
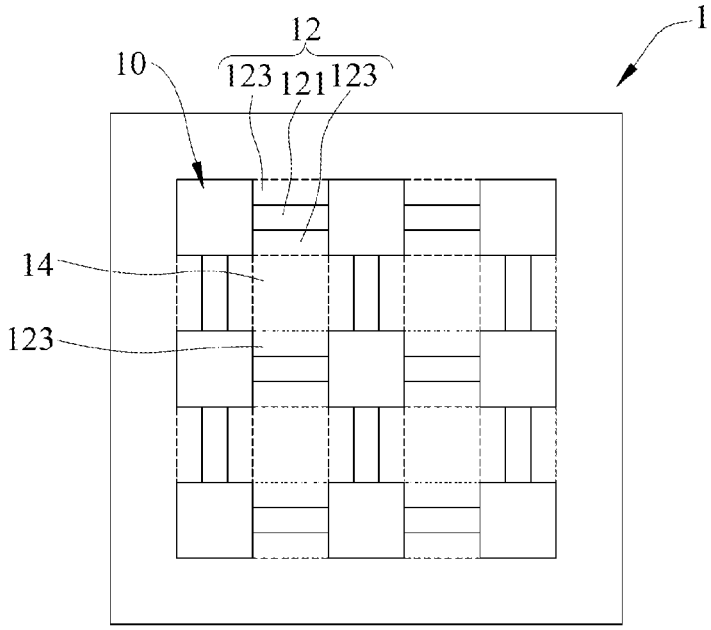
FIGS. 2A to 2C are cross-sectional views illustrating a fabrication method for forming an alloy resistor according to a second embodiment of the present invention.
Figure 2B:
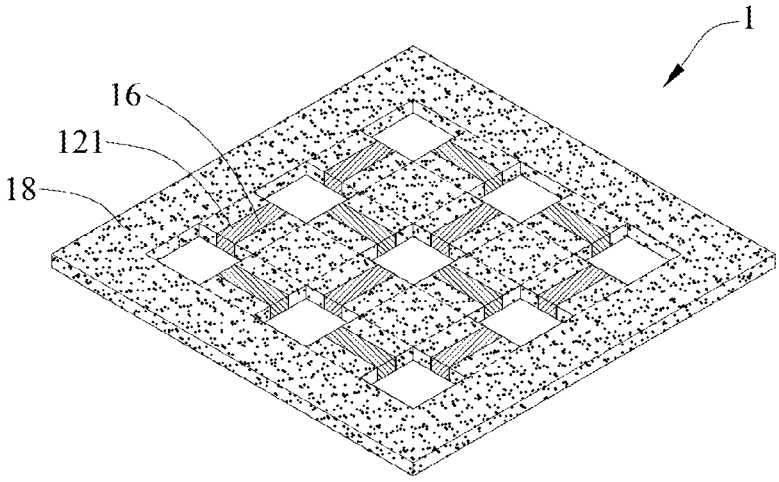
Figure 2C:
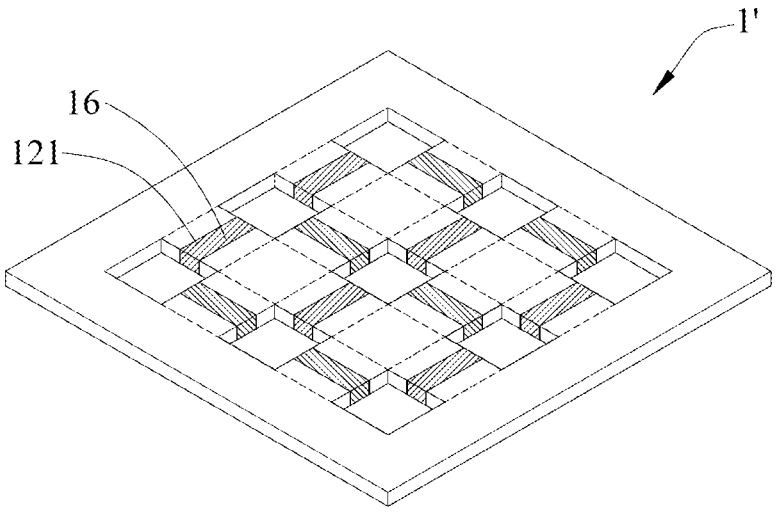
Figure 3:
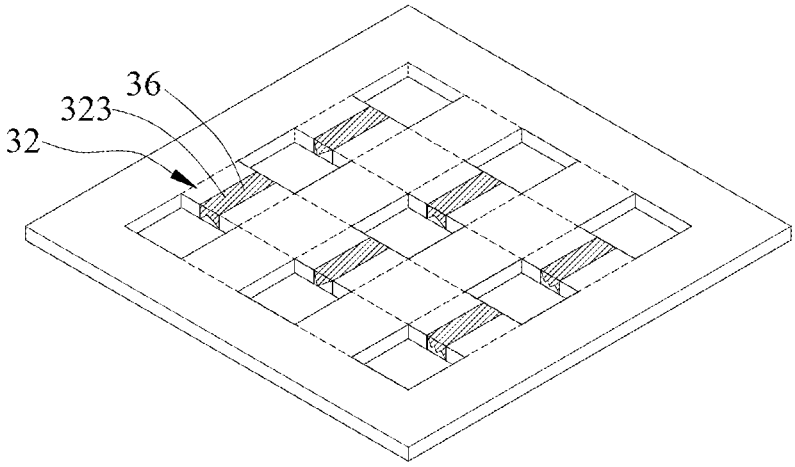
FIG. 3 (PRIOR ART)
FIG. 3 is a schematic diagram illustrating a conventional method for forming an insulating layer.

FIG. 2A to 2C are schematic diagrams illustrating a method for manufacturing an alloy resistor according to a second embodiment of the present invention. In this embodiment, the alloy resistor units 12 of the alloy sheet 1 are arranged in a staggered array and further include a connecting portion 14 joining two adjacent electrode ends 123 of alloy resistor units 12. In details, the connecting portion 14 is for connecting a back electrode end 123 from one of the alloy resistor units 12 with a front electrode end 123 from another alloy resistor units 12. On the other hand, the separated alloy resistor units 12 can be obtained by cutting the connecting portion 14.

In the present invention, a plurality of openings spacing apart from each other and going through the alloy sheet are formed on the alloy sheet, and the alloy sheet with a side surface of the openings is covered with a ring-shaped insulating layer by an electrodeposition coating process, wherein the insulating layer is formed by a plating material with positive or negative ions, as a result, an insulating layer having a smooth surface can be obtained. The mechanism of electrodeposition is that the plating material is dispersed in the water. When the electrodeposition system is electrical conductive by applying a voltage, the plating material will deposit on the surface of the insulating cover area, and forms a uniform and insoluble insulating layer. One of advantages of electrodeposition is that it can obtain a uniform coating film by adjusting the applied voltage and also due to little water and solvent contents in the coating film, a good plating surface is formed and bubbles or void are not produced. Due to a high permeability of liquid coating material, electrodeposition coating process can fully implement the insulating layer on any parts of workpieces that the conventional methods of spray coating or painting cannot achieve. As a result, the corrosion-resisting capability of workpieces will be improved. Another advantage is that after diluting the coating material in electrodeposition coating system with water, the solvent content of coating film is lower and therefore, it is not flammable. Furthermore, the plating material is not greatly depleted, when workpieces are processed with electrodeposition coating. Because of that, the amount of particles decreases and the environment pollution will be reduced significantly.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A fabrication method of an alloy resistor, comprising the steps of:

providing an alloy sheet having a plurality of openings spacing apart from each other and going through the alloy sheet and a plurality of alloy resistor units located between any two adjacent openings, wherein each of the alloy resistor units has an insulating cover area and a plurality of electrode ends on both sides of the insulating cover area;

forming an insulating layer on a surface of the insulating cover area of the alloy resistor units by an electrodepositing coating process, wherein the formation of the insulating layer comprises the steps of: forming a deposition resistant layer on a surface of the alloy sheet for exposing the insulating cover area of the alloy resistor units; forming the insulating layer by the electrodepositing coating process; and removing the deposition resistant layer;

cutting the alloy sheet to obtain a plurality of separated alloy resistor units; and forming a conductive adhesion material on the electrode ends of the alloy resistor units.

2. The fabrication method of claim 1, wherein the openings are formed by a stamping process.

3. The fabrication method of claim 1, wherein the conductive adhesion material is made of one or more selected form the group consisting of nickel and stannum.

4. The fabrication method of claim 1, further comprising forming a conductive layer on the electrode ends after covering the insulating layer.

5. The fabrication method of claim 4, wherein the conductive layer is made of copper.

6. The fabrication method of claim 1, further comprising forming a conductive layer on the electrode ends by barrel plating after separating the alloy resistor units.

7. The fabrication method of claim 6, wherein the conductive layer is made of copper.

8. The fabrication method of claim 1, wherein the alloy sheet further comprises a connecting portion joining two adjacent electrode ends of alloy resistor units.

* * * * *